United States Patent [19]

Forshee

[11] Patent Number: 4,885,882

[45] Date of Patent: Dec. 12, 1989

[54] DECK COVERING

[76] Inventor: Gregory Forshee, 39138 Faith Dr., Sterling Heights, Mich. 48310

[21] Appl. No.: 158,842

[22] Filed: Feb. 22, 1988

[51] Int. Cl.[4] ..... E04F 11/16

[52] U.S. Cl. ..... 52/177; 52/727

[58] Field of Search ..... 52/58, 60, 97, 102, 52/105, 177, 179–181, 211, 301, 309.15, 403, 408, 727, 730, 376, 309.14; 296/181, 183

[56] References Cited

U.S. PATENT DOCUMENTS

| | | | |
|---|---|---|---|
| 965,595 | 7/1910 | Nicholson | 52/727 X |
| 1,091,214 | 3/1914 | Gruber | 52/177 X |
| 2,120,450 | 6/1938 | Wallace | 52/376 |
| 2,178,388 | 10/1939 | Beckman | 52/727 X |
| 2,851,742 | 9/1958 | Johnston | 52/211 |
| 3,229,433 | 1/1966 | Miles | 52/309.14 |
| 3,271,787 | 9/1966 | Clary | 52/403 X |
| 3,341,994 | 9/1967 | Olson | 52/204 |
| 3,365,221 | 1/1968 | Jureit | 52/177 X |
| 3,443,345 | 5/1969 | Spencer | 52/211 |
| 3,470,666 | 10/1969 | Mod et al. | 52/311 |
| 3,478,478 | 11/1969 | Luebs | 52/211 X |
| 3,590,541 | 7/1911 | Epstein et al. | 52/311 |
| 3,950,904 | 4/1976 | Littman | 52/105 |
| 4,313,688 | 2/1982 | Daniels | 403/189 |
| 4,653,242 | 3/1987 | Ezard | 52/727 |
| 4,742,654 | 5/1988 | Cole | 52/97 |

FOREIGN PATENT DOCUMENTS

| | | | |
|---|---|---|---|
| 534795 | 1/1955 | Belgium | 52/181 |
| 323100 | 7/1902 | France | 52/727 |

*Primary Examiner*—Carl D. Friedman
*Assistant Examiner*—Michele A. Van Patten
*Attorney, Agent, or Firm*—Gifford, Groh, Sheridan, Sprinkle and Dolgorukov

[57] ABSTRACT

A cover for a wooden deck structure which protects people walking on the deck structure from splinters. In one embodiment, the cover is in the form of a thin walled, U-shaped channel member which fits over one board of the deck structure. In doing so, the central section of the channel member overlies the top of the board while the sides of the channel member extend downwardly along the sides of the boards. The channel member is made of a synthetic extrudable material, such as vinyl, and is attached to the board by gluing.

In a second embodiment, the cover is made from a plurality of elongated, flat strips haivng a tongue on one side and a matching groove on its other side. The strips are positioned on top of the deck strucuture so that the tongue and grooves of adjacent strips interlock and are attached to the deck structure by glue. In addition, the longitudinal axes of the strips can be transverse with respect to the axes of the boards in the deck structure.

9 Claims, 1 Drawing Sheet

DECK COVERING

BACKGROUND OF THE INVENTION

1. Field of the Invention

The present invention relates generally to covers and, more particularly, to a cover for a wooden deck structure.

2. Description of the Prior Art

The use of wooden decks has enjoyed increased popularity in recent years. Although the actual design of the deck varies form one deck to the next, all wooden decks are constructed from wooden boards which are secured to a substructure or frame in a side by side relationship. The boards for these decks are available in a number of conventional sizes, e.g. 2×2, 2×4 and 2×6 inches.

There are two common methods for building the deck. In the first method, the boards are placed in a side-by-side relationship but are spaced apart from each other. This spacing provides a gap between adjacent boards for water draingage through the deck. In the second method, the boards are placed in a side-by-side abutting relationship and the deck is usually built at an angle with respect to the horizontal plane for water drainage.

One disadvantage of all wooden decks, regardless of how they are constructed, is that the decks splinter and cause splinters to be imbedded in the feet, knee, etc. of people who walk or crawl on the deck. Furthermore, such splintering typically increases with the age of the deck and as the deck wood dries.

SUMMARY OF THE PRESENT INVENTION

The present invention overcomes the above discussed disadvantage of wooden decks by providing a cover for the deck which protects users of the deck from splintering.

In the preferred embodiment of the invention, best suited for decks having boards which are spaced apart from each other, the cover comprises a thin walled, U-shaped channel member constructed of an extrudable material, such as vinyl. The channel member is dimensioned so that the central section of the channel member overlies and is closely adjacent the top of one board in the deck. Simultaneously, the sides of the channel member extend along the sides of the deck board so that the channel member covers the top of the board and protects users of the deck from splinters.

The channel member is attached to the board by glue and, preferably, urethane glue. In addition, undercut slots are formed in the bottom od the channel member central section to increase the adherence between the channel member and the board.

In a second form of the invention, best suited for decks having boards which abut against each other, the cover comprises a plurality of elongated flat strips, each constructed of an extrudable material, such as vinyl. A tongue is formed along one side of each strip while a matching groove is formed along the other side of the strip.

The strips are then placed transversely across the deck boards in the side-by-side relationship so that the adjacent sides of the strips interlock with each other. The strips are glued to the boards and, like the channel members, preferably include undercut slots for increased adherence between the strips and the deck.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
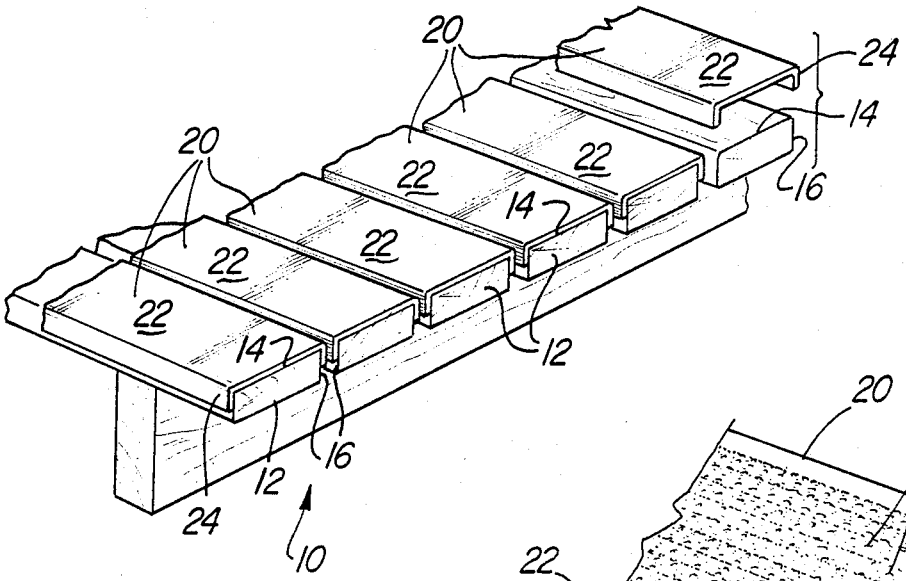
FIG. 1 is a fragmentary perspective view illustrating a preferred embodiment of the present invention installed on a deck.
Figure 2:
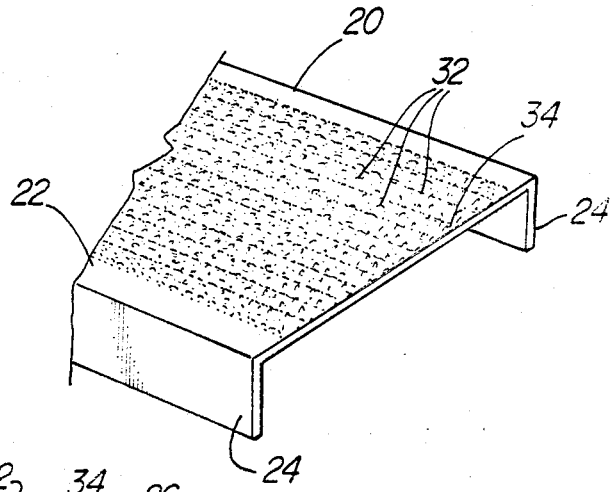
FIG. 2 is a fragmentary perspective view illustrating a preferred embodiment of the present invention.

With reference first to FIGS. 1 and 2, a preferred embodiment of the cover 18 of the present invention is thereshown for use with a wooden deck 10. The deck 10 is constructed from a plurality of elongated wooden boards 12 which are generally parallel to, but spaced part from, each other. Each board 12, furthermore, has a top surface 14 and two sides 16.

It will be understood that the phrase "deck" as used in this specification shall mean any wooden structure, such as a deck, wharf, dock or the like, which is intended to be walked on.

Still referring to FIGS. 1 and 2, the cover 18 comprises a plurality of elongated channel members 20. Only one channel member will be described in detail since a like description shall also apply to the other channel members.

The channel member 20 is generally U-shaped in crossection thus having a central section 22 and two sides 24. The central section 22 and sides 24 are thin walled and preferably of a one piece construction. Any extrudable material, such as vinyl, nylon, plastic or the like, can be used to form the channel member 20. As best shown in FIG. 1, the central section 22 of the channel member 20 is dimensioned so that the central section 22 overlies the top 14 of the boards 12 and, in doing so, the sides 14 overlie at least a portion of the sides 16 of the boards 12. The boards 12 are typically of a conventional crossectional size, such 2×2, 2×4 or 2×6 and the channel member 20 is dimensioned accordingly.

Figure 3:
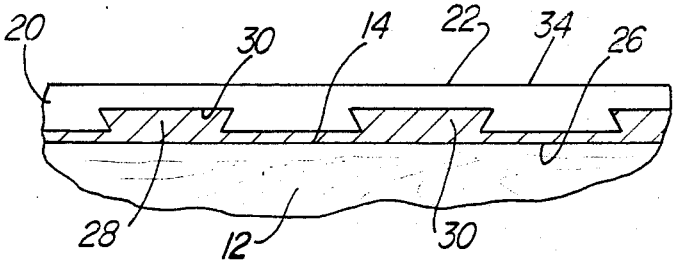
FIG. 3 is a fragmentary, crossectional view illustrating a portion of the preferred embodiment of the present invention.

With reference now to FIGS. 1 and 3, a bottom surface 26 of the central section 22 of the channel member 20 is closely adjacent the top 14 of the board 12 and is attached to the board 12 by glue 28. Urethane glue is the preferred glue due to its flexibility, durability and resistance to breakdown from ultraviolet radiation. Other glues, however, may also be used.

As best shown in FIG. 3, a plurality of slots 30 are formed in the bottom surface 26 of the channel member central section 22. These slots 30 are undercut, i.e. the width of a midpoint of the slot 30 is greater than the width at the bottom surface of the central section 22, to increase the adherence between the channel member 20 and board 12.

A textured pattern 32 (FIG. 2) can also be formed on the top surface 34 of the channel member 20 for increased traction and also for added attractiveness.

In operation, the channel members 20 are glued to the boards 12 so that the channel members 20 cover the boards 12 as shown in FIG. 1. In doing so, the channel members 20 protect against splinters.

Figure 4:
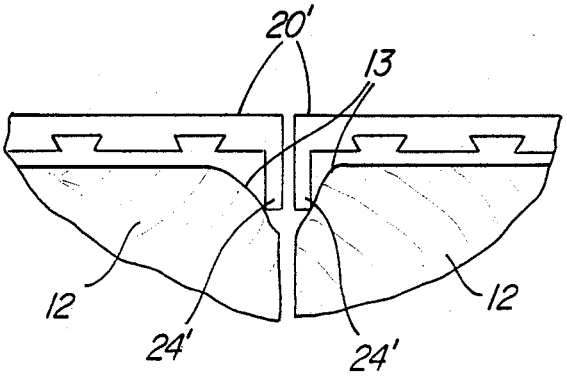
FIG. 4 is a fragmentary end view illustrating a modification of the preferred embodiment of the present invention.

With reference now to FIG. 4, a modification to the present invention is thereshown for use when the boards 12 are positioned closely adjacent, or even abutting, each other. In this case, the sides 24' of the channel members 20' are shorter than that shown in FIGS. 1 and 2 so that the sides 24' can fit in between the rounded corners 13 of the boards 12.

Figure 5:
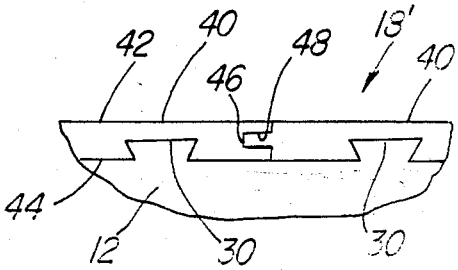
FIG. 5 is a view similar to FIG. 4 but illustrating a second preferred embodiment of the present invention.

With reference now to FIG. 5, a second preferred embodiment of the cover 18' of the present invention is thereshown which is particularly well suited for decks in which the boards 12 are placed in side-by-side abutting relationship. The cover 18' comprises a plurality of elongated, flat strips 40 having a top surface 42 and a bottom surface 44. A tongue 46 is formed on one side of each strip 40 and a matching groove 48 is formed along the opposite side.

The strips 40 are placed transversely across the boards 12 so that the tongue 46 on each strip 40 interlocks with the groove of the adjacent strip 40. The strips 40 are glued to the boards 12 in the previously described fashion and, like the channel members 20, the strips 40 preferably include undercut glue slots 30.

From the foregoing, it can be seen that the present invention provides a simple, inexpensive and yet totally effective cover for a deck structure which protects users of the deck from splinters. Having described my invention, however, many modifications thereto will become apparent to those skilled in the art to which it pertains without deviation from the spirit of the invention as defined by the scope of the appended claims.

I claim:

1. A cover for a board having a top and two sides comprising:

a one-piece generally U-shaped elongated channel member having a planar central section and two side sections, said central section having a substantially flat top surface, a substantially flat bottom surface and dimensioned to overlie said top of said boards, said central section having two spaced apart and parallel sides and said side sections extending outwardly from said sides of said central section, means for attaching said channel member to the board so that said bottom surface of said central section overlies and is closely adjacent the top surface of the board and so that each side section overlies and is closely adjacent at least a portion of its adjacent side of the board, wherein the bottom surface of said central section includes a plurality of spaced apart and parallel slots, wherein said attaching means comprises means for glueing said channel member to the board so that said glue extends into said slots, wherein the width of a midpoint of each slot is greater than the width of said slot at said bottom surface of said central section.

2. The invention as defined in claim 1 wherein said means for gluing comprises a urethane glue.

3. The invention as defined in claim 1 wherein said channel member is made of an extrudable material.

4. The invention as defined in claim 3 wherein said channel member is made of vinyl.

5. A cover for a deck structure of the type having a plurality of elongated boards placed in a side by side relationship said cover comprising:

a plurality of one-piece elongated flat strips, each strip having a top surface, a substantially flat bottom surface and two spaced apart and parallel sides, one side of each strip having a tongue and the other side of each strip having a matching groove, means for attaching said strips to "the" a top of the deck structure so that said bottom surface of said strips are closely adjacent the top surface of the top of the deck structure, said attaching means comprising means for gluing said strips to said deck structure wherein the bottom surface of each said strip includes a plurality of elongated slots, said slots being spaced apart and parallel to each other, said bottom surface being flat between adjacent slots.

6. The invention as defined in claim "10" wherein "the width of a midpoint of" each slot "is greater than the width of said slot at" increases in width from said bottom surface of said strip to a midpoint of said strip.

7. The invention as defined in claim 5 wherein said means for gluing comprises a urethane glue.

8. The invention as defined in claim 5 wherein said strip is made of an extrudable material.

9. The invention as defined in claim 8 wherein said strip is a one piece construction.

* * * * *